United States Patent [19]

Shigeta et al.

[11] 4,074,605

[45] Feb. 21, 1978

[54] KEYBOARD OPERATED ELECTRONIC MUSICAL INSTRUMENT

[75] Inventors: Junnosuke Shigeta; Tomiji Munehiro, both of Hirakata, Japan

[73] Assignee: Matsushita Electric Industrial Co., Ltd., Osaka, Japan

[21] Appl. No.: 685,136

[22] Filed: May 11, 1976

[30] Foreign Application Priority Data

| | | |
|---|---|---|
| May 16, 1975 | Japan | 50-58811 |
| May 16, 1975 | Japan | 50-58834 |
| May 16, 1975 | Japan | 50-58835 |

[51] Int. Cl.[2] ..... G10H 1/00; G10H 5/02

[52] U.S. Cl. ..... 84/1.22; 84/1.19; 84/DIG. 8; 84/DIG. 9; 84/DIG. 23

[58] Field of Search ..... 84/1.01, 1.11, 1.19, 84/1.22–1.24, DIG. 8, DIG. 9, DIG. 23

[56] References Cited

U.S. PATENT DOCUMENTS

| | | | |
|---|---|---|---|
| 3,443,463 | 5/1969 | Campbell | 84/1.01 |
| 3,569,605 | 3/1971 | Adachi | 84/1.22 |
| 3,603,713 | 9/1971 | Nakada | 84/1.19 |
| 3,603,809 | 9/1971 | Uchiyama | 84/1.22 X |
| 3,739,071 | 6/1973 | Niinomi | 84/1.19 |
| 3,749,809 | 7/1973 | Niinomi | 84/1.24 |
| 3,886,834 | 6/1975 | Okamoto | 84/1.19 X |
| 3,902,396 | 9/1975 | Hiyoshi | 84/1.19 |
| 3,939,750 | 2/1976 | Inoue et al. | 84/1.22 |

*Primary Examiner*—Stanley J. Witkowski

*Attorney, Agent, or Firm*—Stevens, Davis, Miller & Mosher

[57] ABSTRACT

A keyboard operated electronic musical instrument such as an electronic organ is disclosed which generates a musical tone signal by mixing together two different musical tone signals of different waveforms and which changes the sound of the generated musical tone by changing a the amount of mixing of the two signals. A clipping gate with a so-called sustain function is included for controlling the attenuation of an input signal as it passes to an output terminal while clipping the input signal gradually and smoothly so that the musical tone does not disappear instantly but attenuates gradually after the release of a depressed key. The input signal to the clipping gate circuit is a square wave signal, and a square wave signal derived at an output thereof is converted to a waveform other than a square wave. When the square wave signal and the non-square wave signal are used as the two different musical tone signals, an unintended change of tone is prevented by designing the system to avoid an abrupt change in the musical tone signal between a sound generated when a key is depressed and an attenuating sound generated when the key is released.

6 Claims, 17 Drawing Figures

KEYBOARD OPERATED ELECTRONIC MUSICAL INSTRUMENT

BACKGROUND OF THE INVENTION

1. FIELD OF THE INVENTION

The present invention relates to a keyboard operated electronic musical instrument such as an electronic organ.

2. DESCRIPTION OF THE PRIOR ART

Recently a keyboard operated musical instrument called a music synthesizer has been used for playing music. This musical instrument operates on the principle of a single oscillator acting as a musical tone signal source. Accordingly, it involves a drawback in that a single musical tone corresponding to only one of several keys depressed simultaneously is generated. Consequently, in playing music, the synthesizer has not been treated as being equivalent to a keyboard operated musical instrument, such as an electronic organ or piano, in which all of the musical tones corresponding to depressed keys are simultaneously generated. Nevertheless it has gradually become popular because it has an advantage in that a player can adjust tone during playing to enhance the playing effect.

SUMMARY OF THE INVENTION

In the light of the above advantages and disadvantages of the prior art musical instrument, it is an object of the present invention to provide a keyboard operated electronic musical instrument which can generate all of the musical tones corresponding to the keys simultaneously depressed and which allows for continuous change and adjustment of tones by a player during playing.

BRIEF DESCRIPTION OF THE DRAWINGS

The above and other objects, features and advantages of the present invention will become more apparent from the following detailed description of the preferred embodiment of the invention when taken in conjunction with the accompanying drawings.

DESCRIPTION OF THE PREFERRED EMBODIMENTS

Figure 1:
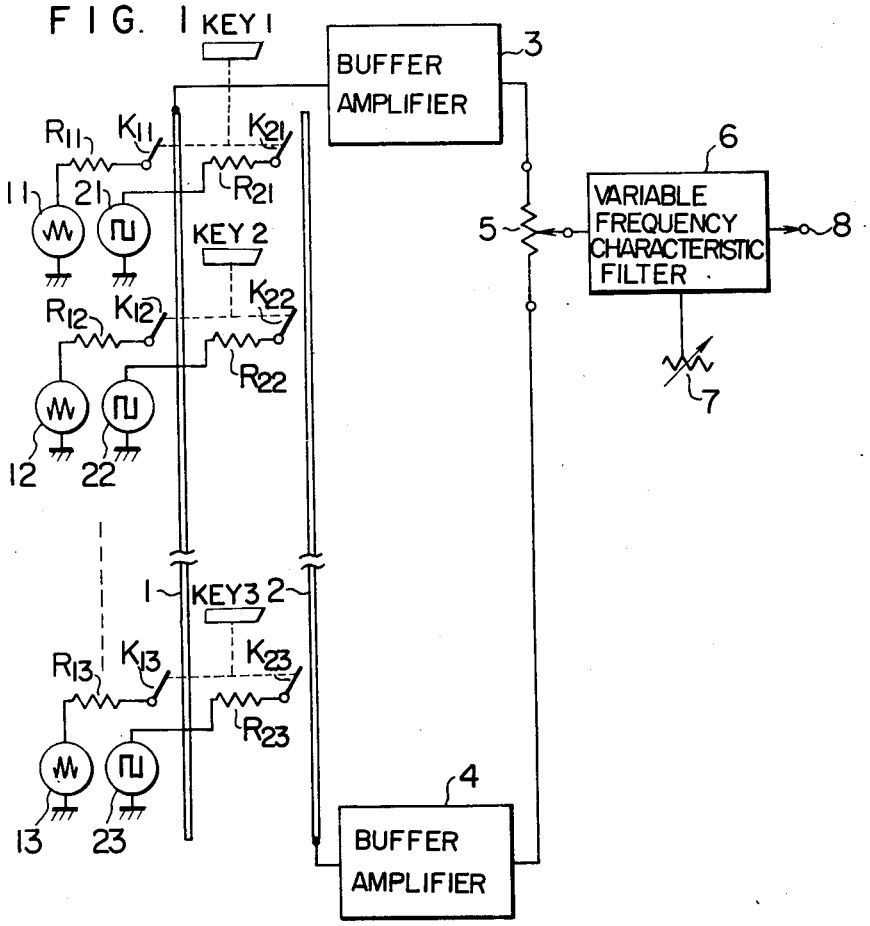
FIG. 1 is a circuit diagram illustrating a main section of one practical embodiment of the present invention.

Referring now to FIG. 1, first musical tone signal sources 11, 12 and 13 for generating, for example, sawtooth waves, output resistors $R_{11}$, $R_{12}$ and $R_{13}$, and key switches $K_{11}$, $K_{12}$ and $K_{13}$ connected to the first musical tone signal sources 11, 12 and 13 through the output resistors, are shown. The other ends of the key switches are selectively connected to a common bus bar 1, which in turn is connected to an input terminal of a buffer amplifier 3 having an appropriate input impedance, which constitutes a musical tone signal processing circuit.

Second musical tone signal sources 21, 22 and 23, output resistors $R_{21}$, $R_{22}$ and $R_{23}$ and key switches $K_{21}$, $K_{22}$ and $K_{23}$ are also provided. The other ends of these key switches are selectively connected to a bus bar 2, which in turn is connected to an input terminal of a buffer amplifier 4 having an appropriate input impedance, which constitutes a second musical tone signal processing circuit. The key switches $K_{21}$, $K_{22}$ and $K_{23}$ are connected to second musical tone signal sources 21, 22 and 23 through output resistors $R_{21}$, $R_{22}$ and $R_{23}$, respectively. A variable resistor 5 is connected between output terminals of buffer amplifiers 3 and 4 and a movable arm of variable resistor 5 is connected to an input terminal of a variable frequency characteristic filter 6. A variable resistor 7 is provided to allow for a change in the frequency characteristic of variable frequency characteristic filter 6. Variable resistors 5 and 7 are arranged such that a player can readily manipulate them. An output terminal 8 is provided, to which an amplifier or speaker, which are not shown, is connected The key switches $K_{11}$ and $K_{21}$, $K_{12}$ and $K_{22}$, and $K_{13}$ and $K_{23}$ are linked together and can be closed by depressing keys K1–K3, respectively.

Figure 4:
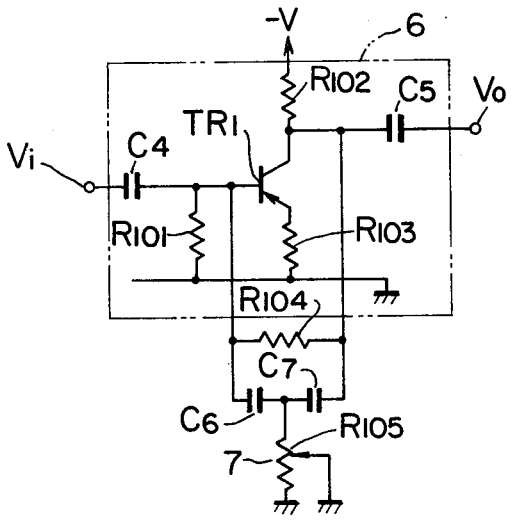
FIG. 4 is a circuit diagram of a variable frequency characteristic filter used in the above practical embodiment.
Figure 5:
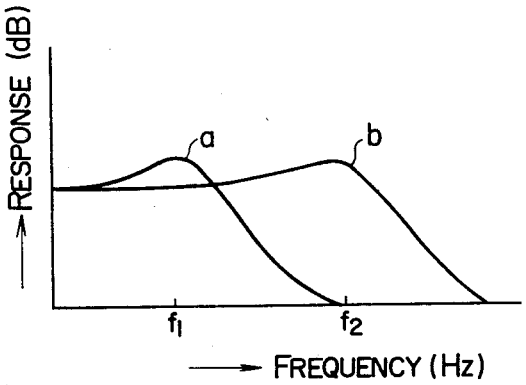
FIG. 5 shows a frequency characteristic of the filter of FIG. 4.

FIG. 4 shows an example of a circuit for variable frequency characteristic filter 6 which includes variable resistor 7, and FIG. 5 shows a frequency characteristic chart thereof.

In FIG. 4, a feedback circuit comprising capacitors $C_6$ and $C_7$, a resistor $R_{104}$ and a variable resistor (7) having any arbitrary resistance value $R_{105}$ is connected between the collector and base of a transistor TR1. The response $V_o/V_i$ shown in FIG. 5 can be changed between a characteristic *a* in which a peak exists at $f_1$ (Hz) and a characteristic *b* in which a peak exists at $f_2$ (Hz) and can be voluntarily set by controlling the variable resistor (7).

Now, supposing that the value of the resistor $R_{105}$ is continuously changed between the minimum value $R_{105MIN}$ and the maximum value $R_{105MAX}$, the frequencies $f_1$ and $f_2$ are defined by the following formulas:

$$f_1 = 2\pi \frac{1}{\sqrt{C_6 C_7 (R_{104} \cdot R_{105MAX})}}$$

$$f_2 = 2\pi \frac{1}{\sqrt{C_6 C_7 (R_{104} \cdot R_{105MIN})}}$$

Figure 2:
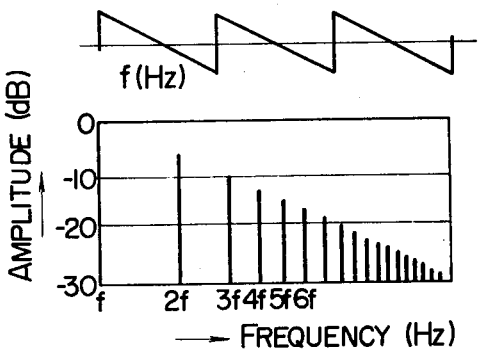
FIGS. 2 and 3 show output signal waveforms together with frequency spectra thereof at various points in FIG. 1.

The operation of the present invention will now be explained. When the keys are depressed such that the musical tones corresponding to the musical tone signal sources 11 and 21, for example, are generated, the key switches $K_{11}$ and $K_{21}$ are closed in linked manner so that the musical tone signal from the first musical tone signal source 11 appears at the output terminal of the buffer amplifier 3 via the resistor $R_{11}$, the key switch $K_{11}$ and the bus bar 1. If the output waveform is a saw-tooth wave, for example, it includes, in addition to a fundamental frequency wave of $f$(Hz), all harmonics of the frequencies $2f$, $3f$, $4f$, $5f$, $6f$, $7f$, $8f$ . . . . , as shown in FIG. 2.

Figure 3:
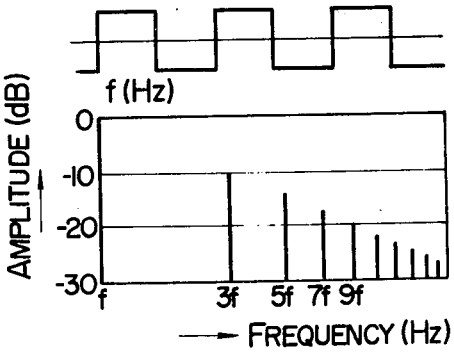

Similarly, the musical tone signal from the second musical tone signal source 21 appears at the output terminal of the buffer amplifier 4 via output resistor $R_{21}$, key switch $K_{21}$ and bus bar 2. If this output waveform is a square wave, for example, it includes, in addition to a fundamental frequency wave of $f$(Hz), odd-order harmonics of the frequencies $3f$, $5f$, $7f$, $9f$ . . . . as shown in FIG. 3. Since the musical tone signals as shown in FIGS. 2 and 3 are applied across variable resistor 5, a musical tone signal of a desired mixing ratio can be derived at the movable arm of variable resistor 5 through the adjustment of the potentiometer arm by a player. The musical tone signal thus derived is applied to the variable frequency characteristic filter 6. Since the frequency characteristic thereof can be changed continuously between a characteristic $a$ in which a peak exists at $f_1$(Hz) and a characteristic $b$ in which a peak exists at $f_2$(Hz) by appropriately adjusting variable resistor 7, a frequency range to be emphasized or deemphasized can be readily controlled during play after the musical tone signals of FIGS. 2 and 3 have been mixed together through variable resistor 5, thereby enhancing the playing effect.

Since first musical tone signal sources 11, 12 and 13 and second musical tone signal sources 21, 22 and 23 in FIG. 1 always generate musical tone signals at musical scale frequencies corresponding to the respective keys even when the keys are not depressed, all of the musical tones corresponding to the depressed keys are generated.

While saw-tooth wave and square wave signals are illustrated as the musical tone signal sources in FIG. 1, other waveforms, may be used. Furthermore, the ratios of fundamental frequencies (musical scale frequenices) in the combinations of 11 and 21, 12 and 22, and 13 and 23 may be different than 1:1.

Figure 6:
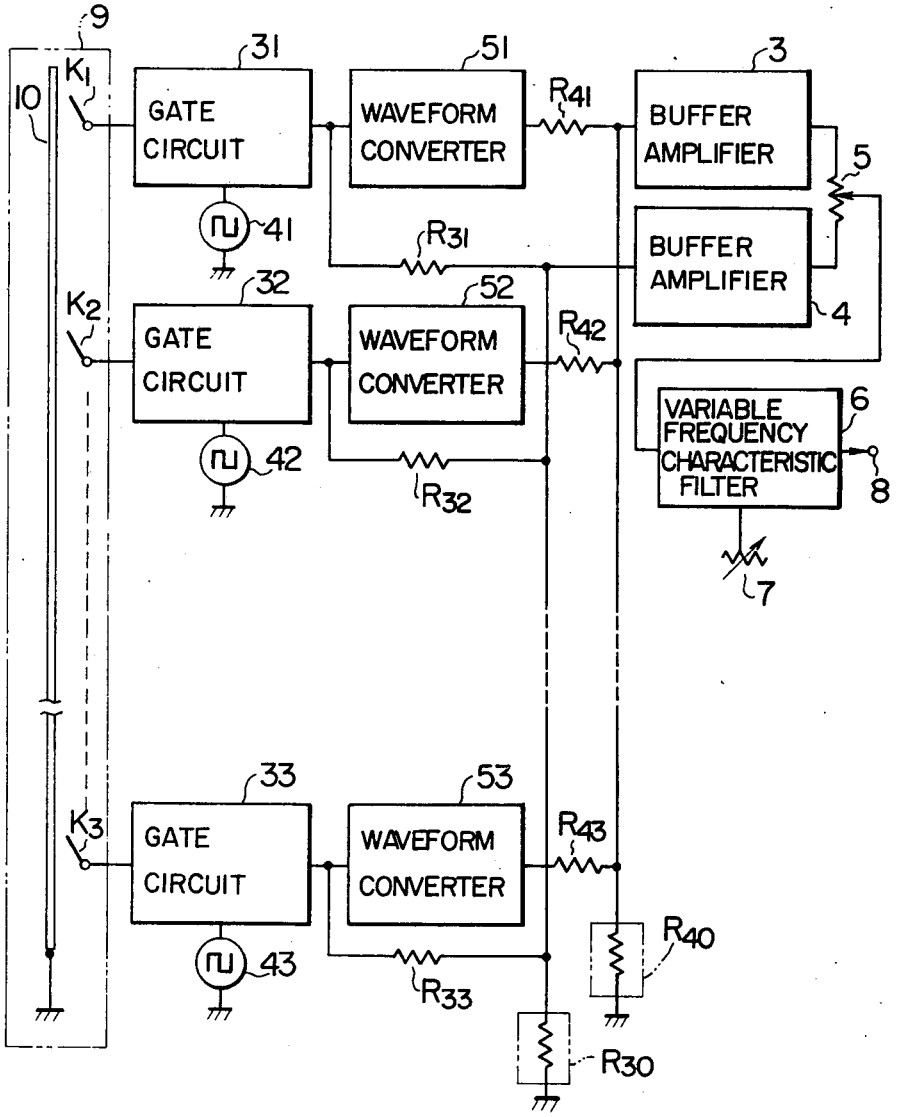
FIG. 6 is a circuit diagram illustrating a main section of another practical embodiment of the present invention.

FIG. 6 shows another practical embodiment of the present invention in which the like reference numerals as in FIG. 1 show elements having the same function. A keyboard 9 comprises key switches $K_1$, $K_2$ and $K_3$ having a bus bar 10 as a common fixed contact. Key switches $K_1$, $K_2$ and $K_3$ are operated by playing keys, which are not shown. Gate circuit 31, 32 and 33, square wave signal generating sources 41, 42 and 43 for generating square wave signals of any duty factor, and waveform converters 51, 52 and 53 connected to the output terminals of gate circuits 31, 32 and 33, respectively, for converting input waveforms to non-square waves such as saw-tooth waves, are provided.

The output signals from gate circuits 31, 32 and 33 are coupled together through resistors $R_{31}$, $R_{32}$ and $R_{33}$, respectively, and all three are coupled to the input of buffer amplifier 4. The output signals from waveform converters 51, 52 and 53 are coupled together through resistors $R_{41}$, $R_{42}$ and $R_{43}$, respectively, and all three are coupled to the input of buffer amplifier 3. Connected between the common junction of resistors $R_{31}$, $R_{32}$ and $R_{33}$ and the ground is a resistor $R_{30}$ which has a sufficiently small resistance (or an input impedance of the buffer amplifier 4) as compared with resistors $R_{31}$, $R_{32}$ and $R_{33}$, and connected between the common junction of resistors $R_{41}$, $R_{42}$ and $R_{43}$ and ground is a resistor $R_{40}$ having a sufficiently small resistance (or an input impedance of the buffer amplifier 3) as compared with resistors $R_{41}$, $R_{42}$ and $R_{43}$.

The operation of the present embodiment is hereinafter explained.

When the playing keys are not depressed, key switches $K_1$, $K_2$ and $K_3$ are open as shown in the drawing of FIG. 1. When key switch $K_1$, for example, is closed, gate circuit 31 is actuated to pass a square wave signal from square wave signal generating source 41.

The square wave signal passes through resistor $R_{31}$ which is called a second signal path, and applied across the resistor $R_{30}$ and to the input of the buffer amplifier 4 which is called a second musical tone signal processing circuit. Similarly, the square wave at the output of the gate 31 is converted to nonsquare wave by waveform converter 51 and passes through resistor $R_{41}$ which is called a first signal path to appear across resistor $R_{40}$. This signal is applied to the input of buffer amplifier 3 called a first musical tone signal processing circuit. The output signal of buffer amplifier 4 is applied to one end of variable resistor 5, and the output signal of buffer amplifier 3 is applied to the other end of variable resistor 5. Assuming that the output waveform of waveform converter 51 (52 and 53) is a saw-tooth wave, a signal which includes, in addition to a signal having a fundamental frequency or a musical scale frequency $f$(Hz) corresponding to the key switch $K_1$, all harmonics of the frequencies of $2f$, $3f$, $4f$, $5f$, $6f$, $7f$, $8f$ . . . . as shown in FIG. 2, appears at the output terminal of buffer amplifier 3. If the output square wave of the square wave signal generating source 41 is a musical tone signal having a duty factor of $\frac{1}{2}$, a signal which includes, in addition to a signal having the fundamental frequency or the musical scale frequency $f$(Hz) corresponding to the key switch $K_1$, of the odd harmonics $3f$, $5f$, $7f$, $9f$ . . . . as shown in FIG. 3, appear at the output terminal of buffer amplifier 4. Since those output signals are applied to the opposite ends variable resistor 5, a musical tone signal having an appropriate mixing ratio can be derived at the movable arm of variable resistor 5 as a player operates the movable arm, which musical tone signal is applied to the succeeding variable frequency characteristic filter 6. The frequency characteristic thereof can be continuously changed from a characteristic $a$ having a peak of $f_1$(Hz) to a characteristic $b$ having a peak at $f_2$(Hz) as shown in FIG. 5 by controlling variable resistor 7. Accordingly, a frequency range to be enphasized or deemphasized can be readily controlled during play after the musical tone signals (FIGS. 2 and 3) have been mixed together by variable resistor 5 thereby enhancing the playing effect.

Again, since musical tone signal generating sources 41, 42 and 43 always generate musical tone signals at the musical scale frequencies corresponding to the keys even when the keys are not depressed, all of the musical tones corresponding to the depressed keys are generated.

While the saw-tooth wave converter is illustrated as the waveform converter in the present practical embodiment, any other suitable waveform converter such as a triangular wave converter may also be used.

Figure 7:
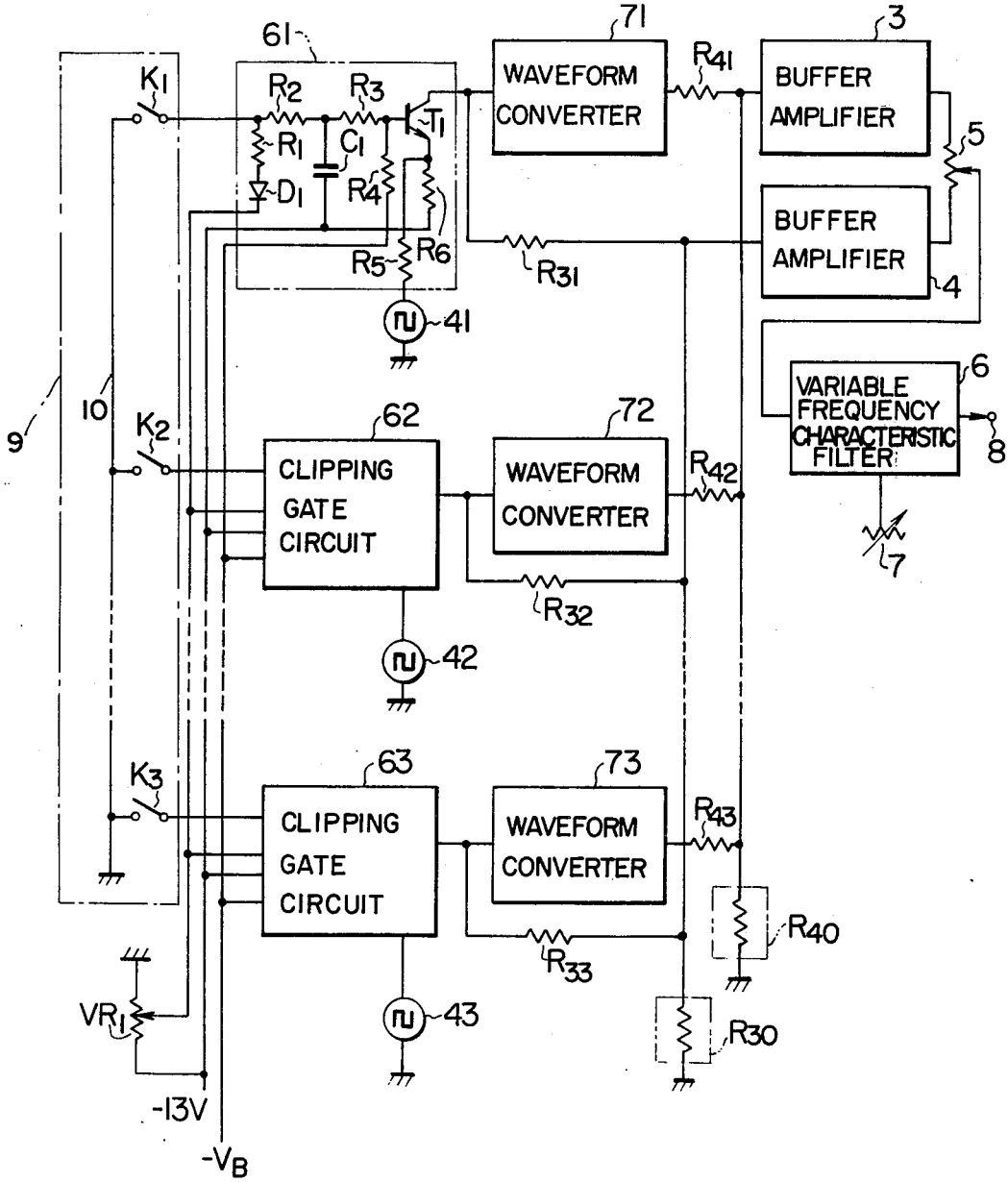
FIG. 7 is a circuit diagram illustrating a main section of a third practical embodiment of the present invention.

FIG. 7 shows a third practical embodiment of the present invention, in which a so-called sustain circuit (hereinafter referred to as a clipping gate) is used to controllably attenuate the transmission of an input signal to an output while clipping the input signal gradually and smoothly so that a musical tone does not disappear immediately but attenuates gradually after a depressed playing key has been released (or after a closed key switch has been opened). When the input signal to the clipping gate circuit is a square wave signal, and a signal of a waveform other than the square wave (e.g. a saw-tooth wave) converted from the square wave signal is used as a musical tone signal, the system is designed such that the analogy of the converted musical tone signal between a sound generated when a key is depressed and a sound generated when the key is released is not lost and a tone can be readily changed or adjusted by changing a mixing ratio of the square wave signal and the non-square wave signal.

Figure 9:
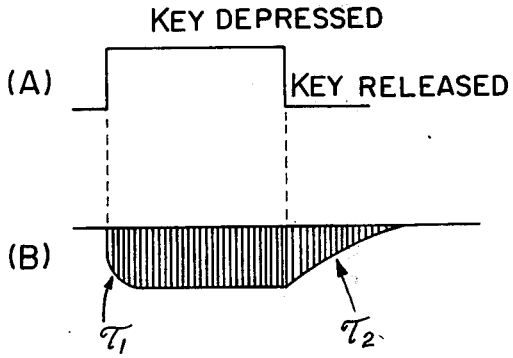
FIGS. 9(A) and (B) show waveforms for explaining a sustaining tone in the circuit diagram of FIG. 7.
Figure 10:
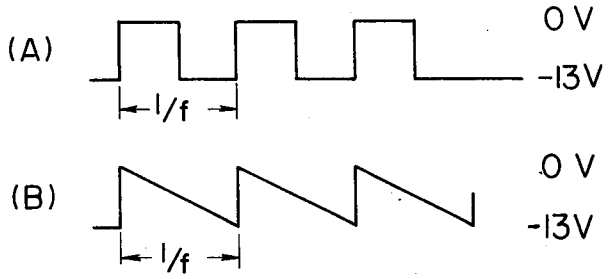
FIGS. 10(A) and (B) show waveforms for explaining a musical tone signal in the circuit diagram of FIG. 7.
Figure 11:
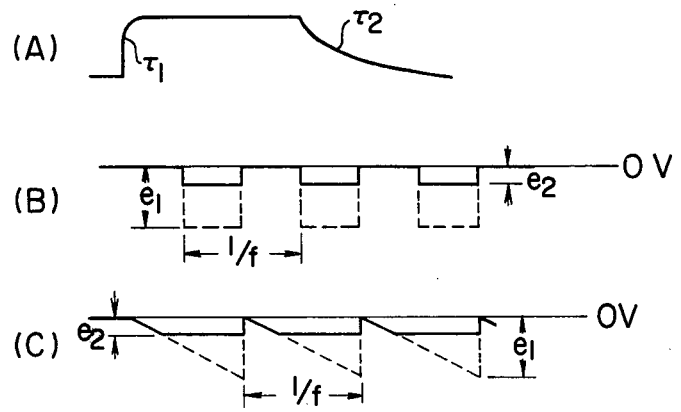
FIGS. 11(A), (B) and (C) show waveforms for explaining the operation of the circuit diagram of FIG. 7 when the musical tone signal waveform is applied thereto.

Heretofore, in the clipping gate circuit for an electronic organ, which constitutes the so-called sustain circuit by which a sound source waveform of a square wave configuration, for example, attenuates gradually as shown in FIG. 9(B) when a depressed key is released as shown in FIG. 9(A), the waveform reaches a maximum amplitude $e_1$ in accordance with a rising time constant $\tau_1$ when the key is depressed and attenuates gradually in accordance with a time constant $\tau_2$ shown in FIG. 11(A) when the key is released. In this case, as shown in FIG. 11(B), since the waveform at the maximum amplitude $e_1$ is analogous to an intermediate waveform, for example at an amplitude $e_2$, there is no difference between a tone of the musical tone generated while the key is depressed and a tone of the attenuating musical tone after the key has been released. However, when a saw-tooth wave as shown in FIG. 10(B), for example, is used as the input signal to the clipping gate circuit, there has been a problem of difference in tone between the musical tone generated while the key is depressed and the attenuating musical tone generated after the key has been released because there is a difference in waveform between a waveform at the maximum amplitude $e_1$ and an intermediate waveform at, for example, the amplitude $e_2$, as shown in FIG. 11(C), in a period $\tau_2$ after the key has been released, as shown in FIG. 11(A).

The embodiment of FIG. 7 overcomes the above difficulities. In FIG. 7, those elements having the same function as in FIG. 6 bear the same reference numerals. A clipping gate 61 comprises a diode $D_1$, resistors $R_1$, $R_2$, $R_3$, $R_4$, $R_5$, $R_6$, a capacitor $C_1$ and a transistor $T_1$. The operation thereof is as follows. When key switch $K_1$, for example, is closed, the base-emitter of transistor $T_1$ is forward biased so that the collector thereof develops a voltage having the maximum amplitude $e_1$ shown by a broken line in FIG. 11(B). This output appears upon the closure of the key switch $K_1$ with a time constant $\tau_1 (\approx C_1 \times R_2)$ and decays upon the opening of the key switch $K_1$ with time constant $\tau_2 (\approx C_1(R_d + R_1 + R_2))$, where $R_d$ is a resistance of the diode $D_1$. The time constant $\tau_2$ can be shortened or lengthened by an adjusting variable resistor $VR_1$. Because the charge on capacitor $C_1$ which has been stored by the closure of key switch $K_1$ is discharged upon the opening of key switch $K_1$, the D.C. potential at the base of transistor $T_1$ gradually changes with time from a forward bias potential toward a cut-off bias potential $(-V_B)$. Thus, the signal from square wave signal source 41, applied to the emitter of transistor $T_1$, appears at the collector of transistor $T_1$ while being gradually clipped as shown by a solid line in FIG. 11(B) because the conduction level of transistor $T_1$ changes with the voltage applied to the base thereof. Reference numerals 62 and 63 designate similar clipping gate circuits as 61. Reference numerals 71, 72 and 73 denote waveform converters which are to be described later.

The operation of FIG. 7 is explained below. When all of the key switches are open, clipping gate circuits 61, 62 and 63 are in their off states and no signal appears at the input terminal of the buffer amplifier 4. Therefore, the input terminal of buffer amplifier 4 is at OV potential as shown in FIG. 11(B).

When key switch $K_1$, for example, is closed, a square wave output signal having the maximum amplitude $e_1$ appears at the junction of output resistor $R_{31}$ of clipping gate circuit 61 and common output impedance element $R_{30}$, i.e., at the input terminal of the buffer amplifier 4 due to a square wave signal as shown in FIG. 10(A) applied to the clipping gate circuit 61 from the square wave signal generating source 41.

Similar operations occur when other key switches $K_2$, $K_3$ are closed. In this manner, square wave signals from square wave signal generating sources 42 and 43 appear at the input terminal of the buffer amplifier 4. The common output impedance element $R_{30}$ is selected to have a sufficiently small impedance as compared with output resistors $R_{31}$, $R_{32}$ and $R_{33}$ in order to prevent any adverse effects on the square wave output signal derived through output resistor $R_{31}$, as for example, by the square wave output signal flowing into waveform converters 72 or 73 via other output resistors $R_{32}$ or $R_{33}$. In this manner, the outputs from square wave signal generating sources 41, 42 and 43 can be applied to the input terminal of buffer amplifier 4 through the respective clipping gate circuits.

Similarly, during closure of the key switch $K_1$, the square wave output signal is applied to waveform converter 71 so that a converted waveform is produced at the output terminal of waveform converter 71.

Figure 8:
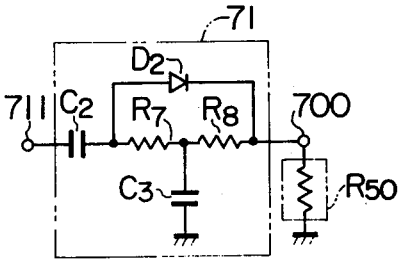
FIG. 8 is a circuit diagram of a waveform converter used in the third practical embodiment.
Figure 12:
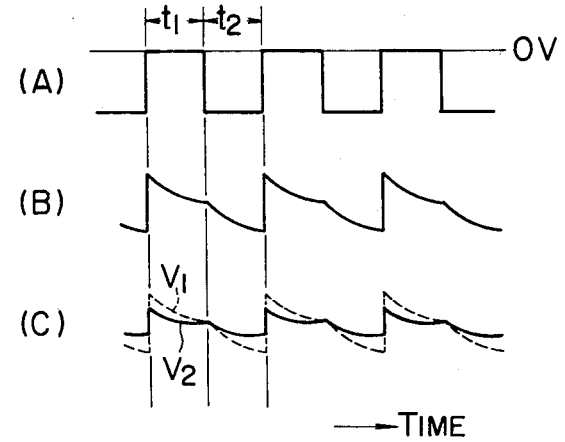
FIGS. 12(A), (B) and (C) show signal waveforms for explaining the circuit diagram of FIG. 8.

FIG. 8 shows a particular example of waveform converter 71. The other waveform converters 72 and 73 can be constructed in the same manner. The operation thereof is as follows. When a square wave output signal as shown in FIG. 12(A) appears at the output terminal of the clipping gate circuit, it is applied to an input terminal 711 in FIG. 8, and a D.C. component of the signal shown in FIG. 12(A) is blocked by a capacitor $C_2$ and only an A.C. component is derived. Since a diode $D_2$ is forward biased during an interval $t_1$, a series circuit of resistors $R_7$ and $R_8$ is shunted by diode $D_2$ which is in its low impedance state. Thus, by selecting the resistor $R_8$ to have a sufficiently large resistance when compared with an output impedance element $R_{50}$, a waveform differentiated by capacitor $C_2$ and output impedance element $R_{50}$ can be derived. During an interval $t_2$, the diode $D_2$ is reverse biased. Therefore, by selecting a time constant of $C_2 \times R_7$ when to sufficiently long to compared with a period $(t_1 + t_2)$ of the square wave signal, a waveform integrated by $C_3$ and $R_7$ can be derived. As a result, a saw-tooth wave as shown in FIG. 12(B) is derived at an output terminal 700 as the converted waveform.

Since the converted waveform having the maximum amplitude $V_1$ is analogous to a decaying waveform having an amplitude $V_2$ developed when a decaying amplitude of the square wave shown in FIG. 12(A) is applied to the input terminal 711 of FIG. 8, as seen from FIG. 12(C), there is no difference between tones generated during the depression of the key and during the release of the key when such a signal waveform is used as musical tone. The duty factor of the input signal need not be limited to ½.

While the circuit of FIG. 8 operates in differentiation mode for the rising transient of the input square wave and in integration mode for the falling transient, it may be designed to operate in the integration mode for the rising transient and in the differentiation mode for the falling transient. In this case, the diode $D_2$ is connected in a reverse polarity from that shown in FIG. 8.

As seen from the above description, the practical embodiment of FIG. 7 can provide a remarkable effect in that it eliminates the unnatural change between the musical tone generated during the depression of the key and the decaying musical tone generated after the release of the key since the analogy of the waveform between the output signal during the depression of the key and the output signal after the release of the key is not lost. The present embodiment can produce at least two different types of output signals such as square wave and saw-tooth wave although it uses a set of clipping gate circuits.

What is claimed is:

1. A keyboard operated electronic musical instrument comprising a plurality of playing keys and a plurality of key switches each playing key actuating a respective key switch, a plurality of gate means coupled to said plurality of key switches, each gate means actuated in response to actuation of a respective key switch, a square wave tone signal generating source applied to each gate means, each of said gate means providing a square wave output signal when actuated, a plurality of waveform converters coupled to respective gate means for converting the output of said gate means to a waveform other than a square wave, a first musical tone signal processing circuit for receiving the output signals from each of said waveform converters, a second musical tone processing circuit for receiving the output signals from each of said gate means, and means for variably mixing the output signals from said first and second tone signal processing circuits and for providing said mixed output signals as a musical tone output.

2. A keyboard operated electronic musical instrument according to claim 1 wherein each said gate means is a clipping gate circuit having a sustain function and including an input terminal for receiving said square wave tone signal, a control terminal connected to one end of a key switch for receiving a switching control signal from the key switch, and an output terminal for providing said square wave output signal, said clipping gate circuit being responsive to the closure of a key switch for providing a constant amplitude square wave output signal and responsive to the opening of the key switch for gradually diminishing the amplitude of the square wave output signal in accordance with a predetermined time constant.

3. A keyboard operated electronic musical instrument according to claim 2 wherein each said waveform converter differentiates applied input square waves from respective gate means in response to transistions of said applied input square waves from a low to a high potential and integrates said applied input square waves in response to transistions of said applied input square waves from a high to a low potential.

4. A keyboard operated electronic musical instrument according to claim 2 wherein each said waveform converter integrates applied input square waves from respective gate means in response to transistions of said applied input sqaure waves from a low to a high potential and differentiates said applied input square waves in response to transitions of said applied input squares waves from a high to a low potential.

5. A keyboard operated electronic musical instrument according to claim 3 wherein each said waveform converter includes an input terminal, an output terminal, a ground terminal, a first capacitor having a first lead connected to said input terminal and a second lead connected to a first lead of a diode and a first lead of a first resistor, a second lead of said first resistor being connected to a first lead of a second resistor and a first lead of a second capacitor, the second leads of said diode and second resistor being connected to said output terminal, a second lead of said second capacitior being connected to ground, and a third resistor connected between said output terminal and ground whereby said first capacitor and third resistor constitute a differentiating circuit when said diode is rendered conductive and said first resistor and second capacitor constitute an integration circuit when said diode is rendered non-conductive.

6. A keyboard operated electronic musical instrument according to claim 4 wherein each said waveform converter includes an input terminal, an output terminal, a ground terminal, a first capacitor having a first lead connected to said input terminal and a second lead connected to a first lead of a diode and a first lead of a first resistor, a second lead of said first resistor being connected to a first lead of a second resistor and a first lead of a second capacitor, the second leads of said diode and second resistor being connected to said output terminal, a second lead of said second capacitor being connected to ground, and a third resistor connected between said output terminal and ground, whereby said first capacitor and third resistor constitute a differentiating circuit when said diode is rendered conductive and said first resistor and second capacitor constitute an integration circuit when said diode is rendered non-conductive.

* * * * *